United States Patent [19]

Bowler

[11] 4,186,708

[45] Feb. 5, 1980

[54] FUEL INJECTION APPARATUS WITH WETTING ACTION

[75] Inventor: Lauren L. Bowler, Bloomfield Hills, Mich.

[73] Assignee: General Motors Corporation, Detroit, Mich.

[21] Appl. No.: 961,843

[22] Filed: Nov. 17, 1978

Related U.S. Application Data

[60] Division of Ser. No. 922,339, Jul. 6, 1978, and a continuation-in-part of Ser. No. 853,331, Nov. 21, 1977, abandoned.

[51] Int. Cl.[2] ..... F02M 39/00; F02B 33/00

[52] U.S. Cl. ..... 123/139 AW; 123/119 R; 261/DIG. 78

[58] Field of Search ..... 123/139 AW, 119 R, 32 EA; 261/50 A, DIG. 78

[56] References Cited

U.S. PATENT DOCUMENTS

| | | | |
|---|---|---|---|
| 3,616,782 | 11/1971 | Matsui et al. | 123/139 AW |
| 3,635,201 | 1/1972 | High | 123/139 AW |
| 3,800,769 | 4/1974 | Graffman | 123/139 AW |
| 3,943,904 | 3/1976 | Byrne | 123/139 AW |
| 3,953,548 | 4/1976 | Knapp et al. | 261/DIG. 78 |
| 3,996,906 | 12/1976 | Bubniak et al. | 123/119 R |

*Primary Examiner*—Charles J. Myhre
*Assistant Examiner*—P. S. Lall
*Attorney, Agent, or Firm*—A. N. Krein

[57] ABSTRACT

A fuel injection apparatus with wetting action for use on a spark ignition internal combustion engine has a fuel injector positioned coaxially above the upstream end of an associated upstanding cylindrical throttle bore in a throttle body so as to discharge liquid fuel in a pulsed spray pattern toward the bore wall above the circular disc type throttle valve pivotably supported in the throttle bore to control air flow therethrough. The spray pattern is such that at closed or nearly closed throttle liquid fuel droplets will travel to the bore wall and collect on the same so as to gravitate downward toward the small openings between opposite sides of the throttle and bore wall for pick up and vaporization by the then substantially sonic air flow through these openings and, under open throttle conditions, the fuel droplets are dispersed in the airstream flowing through the throttle bore before any substantial quantity can reach the bore wall.

3 Claims, 7 Drawing Figures

FUEL INJECTION APPARATUS WITH WETTING ACTION

FIELD OF THE INVENTION

This application is a divisional of my copending application Ser. No. 922,339 filed July 6, 1978, and a continuation-in-part of my application Ser. No. 853,331 filed Nov. 21, 1977, now abandoned.

This invention relates to fuel supply systems for internal combustion engines and, in particular, to a fuel injection apparatus for supplying fuel from a source of fuel at low pressure to the throttle body in such fashion that at low air flow rates, with closed or nearly closed throttle, the fuel wets the bore of the throttle body immediately above the throttle and at other times the fuel is entrained in the air stream before striking the bore.

DESCRIPTION OF THE PRIOR ART

It has been known that in gasoline type internal combustion engines using a carburetor or a pressure carburetor the fuel tends to collect in liquid form on the walls of the intake manifold. Since this fuel collection interferes with metering accuracy under varying engine operating conditions, it is considered undesirable. As to the introduction of the fuel into the air stream, whether it be above the throttle, at the throttle, or below the throttle, and whether it be by fuel injection action or by carburetor action, it has been generally throught desirable to atomize the fuel as much as possible so that it evaporates at the maximum possible rate at all times.

SUMMARY OF THE INVENTION

The present invention provides a fuel spray from a low pressure throttle body injector which is directed towards the walls of the throttle body immediately above the throttle. When the engine operates at closed or nearly closed throttle, at least substantial liquid fuel reaches the walls towards which it is directed. It collects in liquid form on these walls and thereupon tends to gravitate downwardly towards the throttle. As the fuel approaches the throttle, and especially if it travels into the narrow space between the outboard edge of the throttle and the bore of the throttle body, the fuel is wiped by relatively high velocity and hence low pressure air. This condition usually involves sonic air velocities. The fuel subjected to this condition rapidly evaporates and enters the air stream in vaporized, combustible form. When the rate of air flow through the bore is moderate or high, the fuel droplets are drawn into the air stream and do not reach the throttle body bore. Under these conditions, the engine operation is such that the fuel quickly evaporates and a well-distributed fuel/air mixture is provided for combustion in the engine.

Accordingly, it is the primary object of the present invention to provide an improved fuel injection system wherein fuel is injected above the throttle in successive pulses at low pressure and the throttle cooperates with thus-injected fuel to provide evaporation sustained between pulses into a high velocity annular air flow around the throttle under closed or nearly closed throttle conditions, and at moderate or large air flow rates the fuel is carried into the air stream in evaporated form before the droplets can reach the wall of the bore.

It is a more particular object of the present invention to provide an improved low pressure fuel injection system wherein the fuel injector proper and the throttle coact therewith to use advantageously the sonic or near-sonic air flow velocities at closed or nearly closed throttle and the injector system proper coacts with the nearly circular incoming air stream under other conditions to provide a good fuel distribution throughout the air stream without wetting the walls of the throttle body bore.

Another object of this invention is to provide an improved timed fuel injection system for an internal combustion engine wherein a fuel injector receives liquid fuel at low pressure and discharges the same into an associated throttle bore upstream of the throttle therein in a pulsed spray pattern so that during engine idle operating conditions, liquid fuel will wet the throttle bore wall so as to be vaporized by the continued air flow thereover whereby to provide a homogeneous air/fuel mixture to the engine and so that during engine off idle operating conditions the increased air flow carries and vaporizes the fuel before it can reach the throttle bore wall in liquid form.

Still another object of the present invention is to provide an apparatus of the above type which includes features of construction, operation, and arrangement, rendering it easy and inexpensive to manufacture, reliable in operation, readily serviced, and in other respects suitable for use on production motor vehicles.

For a better understanding of the invention, as well as other objects and further features thereof, reference is had to the following detailed description of the invention to be read in connection with the accompanying drawings wherein.

DESCRIPTION OF A PREFERRED EMBODIMENT

Figure 1:
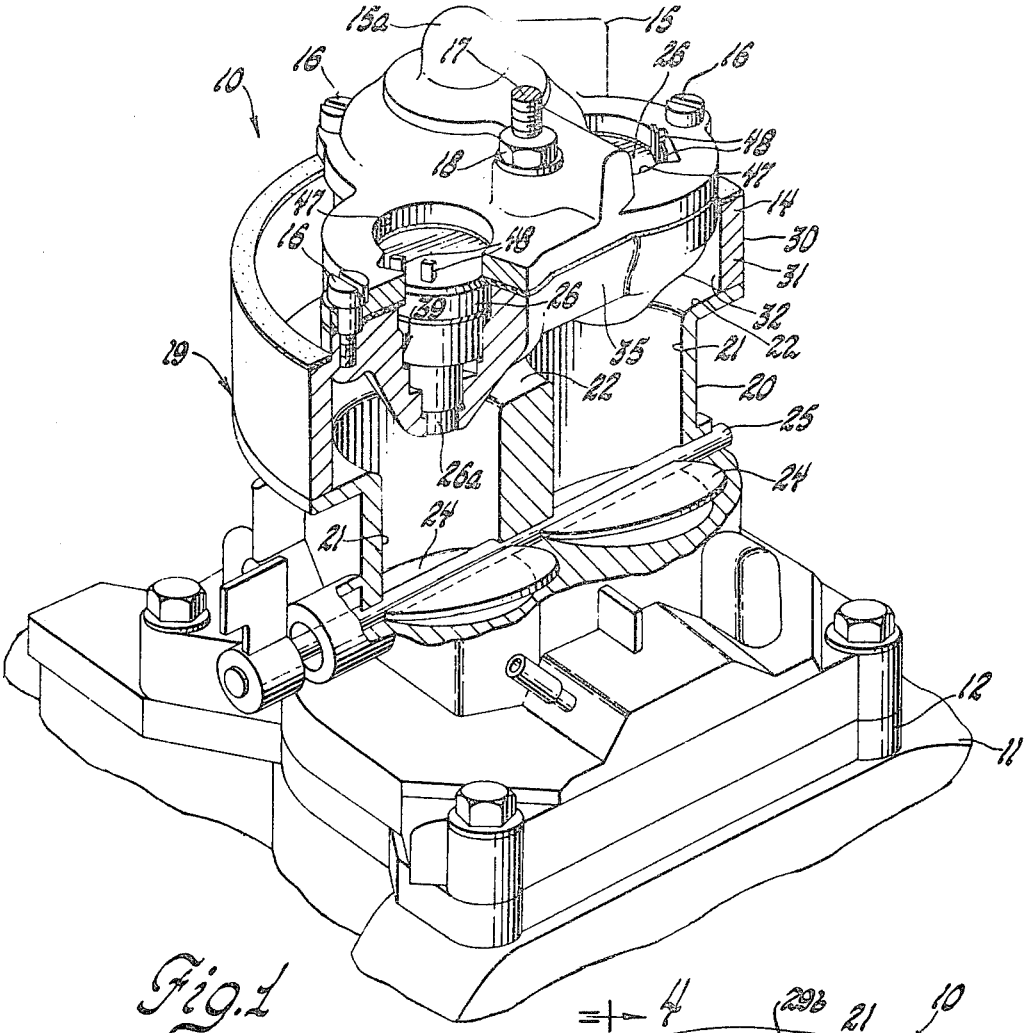
FIG. 1 is a perspective view of a preferred embodiment of a low pressure throttle body injection apparatus in accordance with the invention with the supporting engine parts in fragmentary form and with parts broken away to show its internal structure.
Figure 3:
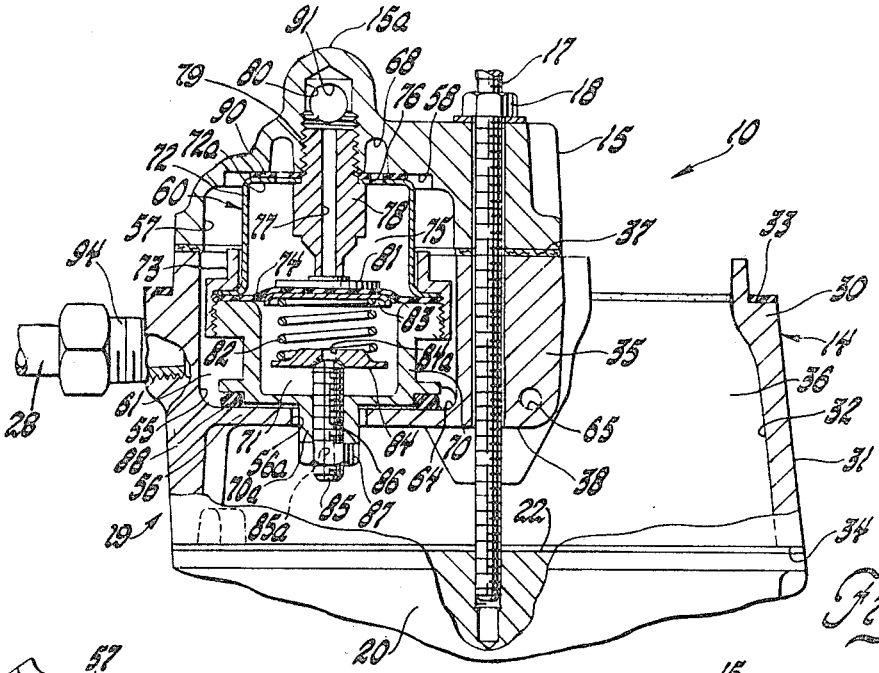
FIG. 3 is a sectional view taken along line 3—3 of FIG. 2 showing the pressure regulator and elements associated therewith with parts in elevation.

Referring first to FIG. 1, the throttle body injection apparatus, generally designated 10, of the invention is shown suitably fixed over the inlet of an engine intake manifold 11 with a heat insulating mounting plate 12 constructed of a fiberboard core with BUNA-Nasbestos facing on both sides or equivalent materials positioned between its lower base surface and the usual machined mounting pad on the top of the intake manifold. For ease of manufacture and assembly, the injector housing means of the subject throttle body injection apparatus, in the construction illustrated, includes a two piece fuel body assembly 19 that includes a fuel body 14 and a fuel body cover 15, suitably secured together as by screws 16, and mounted on a throttle body 20. The fuel body assembly is suitably secured to the throttle body 20 as by means of a threaded stud 17 and nut 18, as shown in FIG. 3. The stud 17 is also used to secure a conventional air cleaner, not shown, to this assembly.

Throttle body 20, in the construction shown, is provided with a pair of throttle bores 21 extending therethrough from an upper surface 22 to a lower surface 23 (FIG. 5) thereof. The throttle bores are cylindrical and have their axes substantially vertical, as shown. Flow through the throttle bores is controlled by throttle valves 24. Each throttle valve 24 is suitably fixed to a valve shaft 25 that intersects these bores and is rotatably journaled in the throttle body 20 whereby operation of these valves may be effected in a conventional manner, not shown, or described since it forms no part of the subject invention. For the same reason, other elements, such as air temperature and flow sensors, which may be associated with throttle body 20 as part of the control system for a fuel injection system are either not illustrated or not fully illustrated and are not described since they are not deemed necessary for an understanding of the subject invention.

To provide for the injection of fuel into the air stream flowing through the throttle bores 21, two electromagnetic fuel injectors 26, of a type capable of operation in a predetermined manner when supplied with fuel at a nominal low pressure of, 6 to 15 psi, for example, are supported by the fuel body 14, in a manner to be described, whereby each fuel injector supplies fuel to a single throttle bore.

The electromagnetic fuel injectors 26, may be of any suitable type but, are preferably of the type disclosed in copending U.S. Pat. application Ser. No. 838,468 entitled "Electromagnetic Fuel Injector" filed Oct. 3, 1977 in the name of James D. Palma, and assigned to a common assignee.

Fuel to be injected by each of the fuel injectors 26 into the induction system of the engine is supplied by a low pressure supply pump, not shown. This pump due to usage of the low fuel pressure referred to above, is preferably a turbine type pump, as distinguished from a positive displacement pump. Such pump is preferably located in the fuel tank which preferably incorporates therein a conventional bottom reservoir, not shown, used to insure a constant supply of fuel to the in-tank pump even at low fuel level and severe maneuvering conditions. At this location, the fuel would have little or no vapor entrapped therein. The fuel under low pressure is conveyed from the tank to the injectors via a suitable supply conduit 27 (FIG. 2) to a fuel delivery passage means which communicates with inlet chamber 61 of the fuel body assembly 19 for flow to the fuel injectors 26 as hereinafter described. Excess fuel delivered to these fuel injectors as described further hereafter, is returned to the fuel tank to mix with the fuel stored therein via a suitable return conduit 28.

Figure 2:
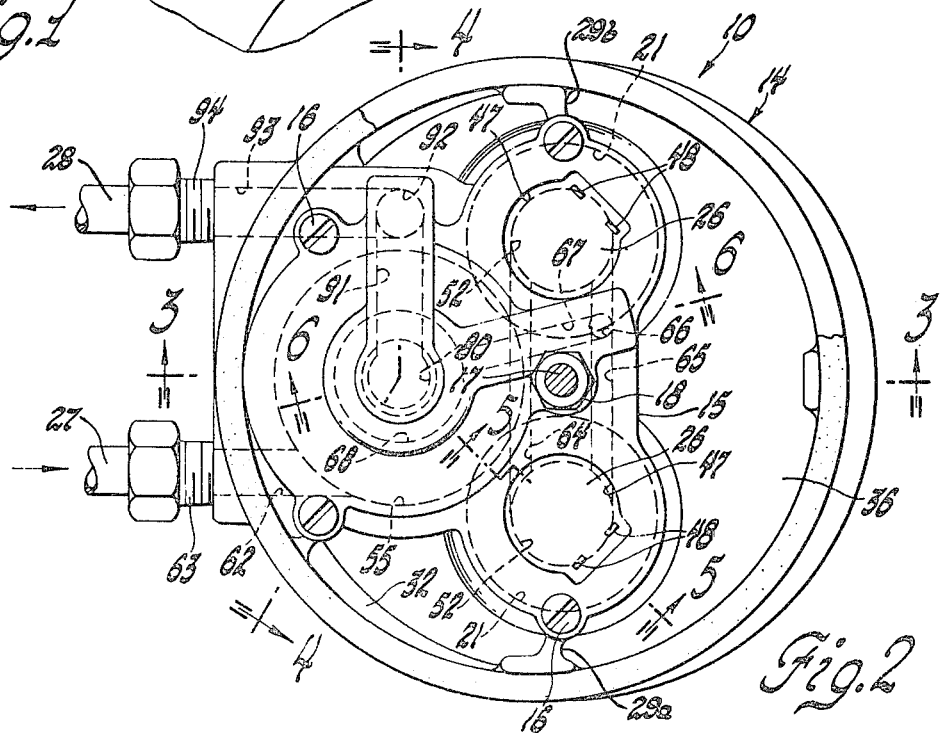
FIG. 2 is a top view of the apparatus of FIG. 1 with parts broken away.

As best seen in FIGS. 1, 2 and 3, the fuel body 14, in the construction shown, is a single casting. It includes an outer annular casing 30 providing outer cylindrical wall surface 31 and inner cylindrical wall surface 32 on the same axis. The cylindrical shape formed at the inner face 32 forms a manifold at the lower part of the body, from which air entering at the top of fuel body 14 is discharged into both throttle bores 21, FIG. 1. Upper and lower annular faces 33 and 34, respectively, are provided on casing 30. Body 14 additionally includes housing 35. As shown, in top plan view in FIG. 2 and in vertical cross-section in FIG. 3, the outer casing 30 is unitary with the housing 35 along the portion of the periphery of the casing 30 spanned by inlet and outlet passages 62 and 93, forming a cantilever-like support as seen best in FIG. 3. Further support is provided by spoke-like webs **29*a* and 29*b*, FIG. 2**.

In the construction illustrated, the lower rim of a conventional air cleaner, not shown, would rest on the upper annular face 33 or on a gasket sandwiched therebetween.

An induction flow passage 36 is thus provided between the inner cylindrical wall surface 32 and the outer side surfaces of housing 35. The cross-sectional flow area of this induction flow passage is preferably at least about twice as large or larger than the combined cross-sectional flow area through throttle bores 21. The upper surface 37 of housing 35 is elevated above upper annular face 33 of casing 30 as shown in FIG. 3. The lower surface of the housing 35 is vertically positioned intermediate the upper and lower faces 33 and 34, respectively.

Figure 5:
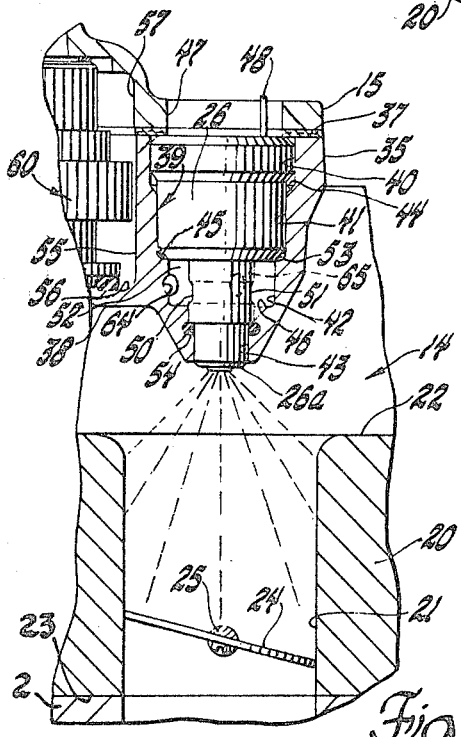
FIG. 5 is a view in elevation of one of the injectors with the associated elements shown in a fragmentary sectional view taken along line 5—5 of FIG. 2.

In the embodiment shown, housing 35 of fuel body 14 is provided with two sockets 39, FIG. 5, (described hereafter) in which the fuel injectors 26 are mounted. As shown, each socket 39 is formed by a through stepped vertical bore in the housing 35 that is substantially coaxial with one of the throttle bores 21 in the throttle body 20, as shown in FIG. 5. The socket is sized to correspond to the electromagnetic fuel injector 26 to be mounted therein. In the construction shown, each socket 39 provides a cylindrical upper wall 40, a cylindrical intermediate wall 41, a cylindrical lower intermediate wall 42 and cylindrical lower stepped wall 43. Such walls are progressively reduced diameters relative to the wall next above. Walls 40 and 41 are interconnected by a bevel shoulder 44. Walls 41 and 42 are connected by a more nearly flat shoulder 45. Walls 42 and 43 are connected by another nearly flat shoulder 46. Each electromagnetic fuel injector 26 is retained in the socket 39 in which it is mounted by the overlaying portion of the fuel body cover 15. Cover 15 has suitable apertures 47, to provide access to the electrical terminals 48 of the electromagnetic fuel injector 26. Electrical control circuit wires, not shown, are attached to the terminals and extend to a suitable electronic control circuit (not shown) that is operative to energize and de-energize each of the injectors as a function of engine operation in a desired manner as known in the art.

Each electromagnetic fuel injector 26 is positioned in its socket so that is spray tip end **26*a*, FIG. 5, is located at a predetermined axial spaced distance above the inlet end of the throttle bore 21 with which it is associated. The spray cone defined by liquid fuel discharged therefrom impinges on the cylindrical throttle bore wall 21, FIG. 5. The atomized fuel impinges on the upper portion of the throttle bore wall, but does not extend to the horizontal adjacent annular surface 22, FIG. 5. The spray also impinges on the upstream face of the throttle valve 24. Thus the position of the spray tip end 26*a* above the inlet end of the throttle bore 21** is preselected to provide for the above-described fuel spray flow pattern.

The spray pattern of the fuel injector provides maximum liquid fuel discharge towards the cylindrical wall 21, and minimum towards the throttle 24 and the surface 22. In the preferred form of this invention, the fuel is delivered through the fuel injector in pulses. These pulses may be constant repetition rate, but of varying length, or they may be of uniform length and varying repetition rate, or a combination of varying repetition rate and varying length. Under low air flow rates, with the throttle closed or nearly closed, the fuel droplets can travel to the wall surface 21 so that each pulse event causes liquid fuel on this surface. The resulting film of liquid fuel tends to descend down the wall to points near the throttle where the high air velocity and low pressure encourage vaporization.

The portions of the housing of the fuel injector 26 including the portion thereof containing the fuel inlet port 50 of the injector defines with the lower intermediate wall 42 and shoulder 46 an annular fuel chamber 52, FIG. 5. In a construction of FIGS. 1–5 made for use with a 350 cubic inch V-8 engine the diameter of the intermediate wall 42, FIG. 5, was 0.92 inches and its height was 0.36 inches. The volume of the annular fuel chamber 52 was 0.239 cubic inches. In operation, fuel flows into this passage at 15–22.5 gallons per hour, regardless of the rate of fuel injection, and the part of such flow going into the engine is less than a third of this amount. While these values are not deemed critical, they indicate ones that have been found effective.

Suitable O-ring seals 53 and 54 are used to effect seals between housing of the electromagnetic fuel injector 26 and suitable wall surfaces of the socket cavity with which it is associated on opposite ends of the fuel chamber 52.

Figure 4:
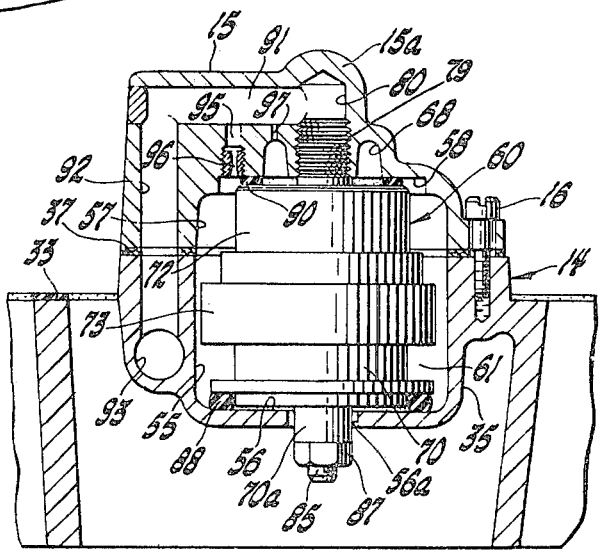
FIG. 4 is a view in elevation of the pressure regulator of the apparatus of FIGS. 1–3 with the associated elements in sectional view taken along line 4—4 of FIG. 2.

Fuel body 14, as best seen in FIGS. 3 and 4, is provided with an internal cylindrical wall 55 and a bottom wall 56 while its cover 15 is provided with an internal cylindrical wall 57 and upper wall 58 to define a chamber in which is mounted a fuel pressure regulator, generally designated 60 that forms with these walls an inlet fuel reservoir 61. The inlet fuel reservoir 61 is defined by cylindrical vertical walls 55, 57, FIGS. 2 and 3 and by the outer casing of the pressure regulator 60, FIG. 3.

Fuel is supplied to the inlet fuel reservoir 61, FIG. 3, via an inlet passage 62, FIG. 2, in fuel body 14 that opens at one end into reservoir 61 and is connected as by conduit fitting 63 and the supply conduit 27, FIG. 2, to the vehicle fuel tank or other suitable source of fuel, at a suitable low pressure of, for example, in the range of 6 to 15 psi. The fuel thus made available is relatively cool in relation to the temperatures present at the engine block and in the engine compartment of a vehicle. The fuel can be delivered at such a low pressure by a single in-tank fuel pump, preferably of the turbine type. Such fuel supply pumps are well known in the art. Fuel from the fuel reservoir chamber 61, FIG. 3, is delivered to the injector sockets by a fuel supply passage 64, FIGS. 2, 3, and 5. This passage extends horizontally in the housing 35 between the injector sockets as seen best in FIG. 2. This passage is so located that it also intersects the cylindrical chamber 61, as seen particularly in FIG. 3, so that fuel is delivered from chamber 61 to the respective injector sockets.

Figure 6:
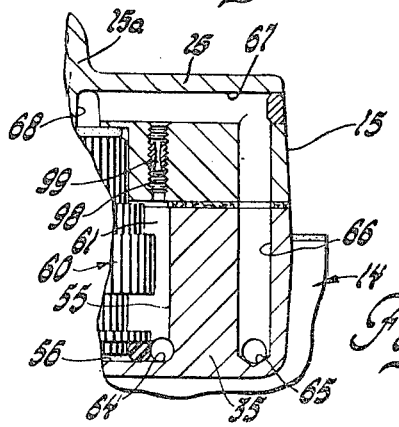
FIG. 6 is a fragmentary view taken along line 6—6 of FIG. 2 but showing an alternative form of the vapor return passage.

Excess fuel not injected into the induction passage means by the electromagnetic fuel injectors 26 is returned to the supply tank, not shown. To effect this, the fuel chambers 52, FIG. 5, of the injectors are connected by a common horizontal fuel return passage 65, FIGS. 2 and 3, in the housing 35 of the fuel body 14 to the lower end of a substantially vertical riser fuel return passage 66, provided in part in fuel body 14 and in part in cover 15 as best seen in FIG. 6. The latter communicates with horizontal passage 67 which extends toward the axis of the fuel regulator as shown in FIGS. 2 and 6. Passage 67 is provided in a raised boss 15*a* in cover 15 so as to be in fluid communication with a cylindrical open end channel 68, FIG. 3, in cover 15. Channel 68 encircles the axis of a raised boss 15*a* of cover 15, and is defined by an annular upwardly recessed groove formed in the upper wall 58 of the fuel body cover 15.

Any suitable fuel pressure regulator may be used. In the construction shown in FIG. 3, the fuel pressure regulator 60 includes a lower cup-shaped base 70 providing a first compartment 71. An inverted cup-shaped cover 72 is secured to the base 70 by a flange nut 73 threaded to the base. A flexible diaphragm 74 is secured between the base 70 and cover 72 to define a fuel return chamber 75 with the cover 72 and for separating compartment 71 from chamber 75.

Fuel inlet to the fuel return chamber 75 of the pressure regulator 60 is by means of a plurality of spaced apart apertures 76 in the upper wall 72*a* of cover 72. Fuel outlet from the regulator is by means of a substantially vertical through outlet passage 77 in the tubular valve seat element 78 that extends through a central aperture in the upper wall of the cover 72 which is provided for this purpose. The valve seat element 78 is suitably secured, as by an annular soldered joint, for example, to the cover 72. The lower end of the valve seat element 78, with reference to FIG. 3, extends a predetermined distance below the upper wall 72*a* to form an annular seat for valve 81. The opposite end of the valve seat element 78 is provided with external threads 79 for threaded engagement with the internally threaded vertical bore 80 that extends from upper wall 58 into the boss 15*a* of cover 15. With this arrangement, the pressure regulator 60 is adjustably secured to the cover 15 so that the housing means of this regulator depends into the cavity, previously described, that is provided in the fuel body 14 and cover 15.

Flow from the fuel return chamber 75 out through the outlet passage 77 is controlled by a diaphragm actuated valve 81 in the form of a disc suitably fixed to the upper or fuel return chamber side of diaphragm 74 for up and down movement therewith relative to the lower free end of valve seat element 78. Valve 81 is normally biased with a predetermined force into seating engagement with this end of the valve seat element 78 by means of a spring 82 positioned in compartment 71 so as to abut at one end against a disc retainer 83 fixed to the lower compartment 71 side of diaphragm 74. Spring 82, at its other end abuts against a spring seat disc 84. The spring seat disc has a central aperture 84*a* therethrough. This spring seat disc 84 is adjustably positioned in one direction axially within the compartment 71 by a spring pressure adjusting screw 85 that is threaded into the internally threaded aperture 86 through the central depending boss 70*a* of base 70. A nut 87 threaded onto screw 85 is used to releasably lock the screw 85 in its designed adjusted position.

The boss 70*a* is loosely received through an aperture 56*a* in the bottom wall 56 of the housing 35 of the fuel body 14. The screw 85 is provided with a through passage 85*a* aligned with the aperture 84*a* in spring seat disc 84 whereby the compartment 71 is placed in fluid communication with the fluid flowing within the induction flow passage 36.

As previously described, fuel pressure regulator 60 forms with the chamber defined by walls 55 and 56 of fuel body 14 and walls 57 and 58 of cover 15 an inlet fuel reservoir 61 which is flow isolated from the aperture 56*a* by means of a suitable seal, such as O-ring seal 88, positioned to encircle aperture 56*a* radially outward thereof. In the construction shown, the seal 88 is sandwiched between a lower flanged exterior wall surface 70*b* of base 70 and the bottom wall 56. Inlet fuel reservoir 61 is flow isolated from the annular fuel return channel 68 in cover 15 and from the inlet apertures 76 in the cover 72 of the fuel pressure regulator 60 by an O-ring seal 90 that is suitably sandwiched between the upper wall 72*a* of the cover 72 of the pressure regulator 60 and the upper wall 58 of cover 15.

Fuel flows from the fuel return chamber 75 out through the outlet passage 77 in the valve seat element 78 into the return passage provided by bore 80 in cover 15 then flows via a substantially horizontal return passage 91 that is in communication at one end with bore 80. At its other end this passage 91 is in communication with the upper end of a substantially vertical fuel return passage 92, FIG. 4, provided in part in cover 15 and in part in fuel body 14. Fuel return passage 92, at its lower end is in communication with a substantially horizontal discharge passage 93 provided in fuel body 14 as best seen in FIGS. 2 and 4. The discharge passage 92 is connected as by a conduit fitting 94 to the return conduit 28 whereby the excess fuel is returned to the fuel tank used to supply fuel to the engine.

The passages 65, 66 and 67 and the annular channel 68 thus define a first fuel return passage means connecting the outlet ports 51 of the electromagnetic fuel injectors 26 and the fuel return chambers 52, supplying fuel to these injectors, to the inlet side of the fuel pressure regulator 60, as provided by the inlet apertures 76 thereof. The passage means, as provided by the bore 80 and the passage 91, 92 and 93, is defined as a second fuel return passage means that connects the outlet side thereof, as provided by the passage 77, of the fuel pressure regulator 60 to the engine fuel tank, not shown, in the manner previously described whereby excess fuel is returned via this passage means at a pressure corresponding to the pressure of fuel in the fuel tank, a pressure at or substantially corresponding to atmospheric pressure, assuming the fuel tank is properly vented in a conventional manner.

To permit satisfactory operation of the electromagnetic fuel injectors 26 and of the fuel pressure regulator 60 while using gasoline fuel at a low supply pressure of 6 to 15 psi, suitable vapor bleed passage means are provided in the subject assembly whereby fuel vapors can be separated from the liquid fuel flow before the liquid fuel is supplied to these elements of the assembly.

For this purpose, a vapor bleed passage 95 having a vapor bleed orifice passage 96 of predetermined diameter therein is provided in the fuel body cover 15, so as to open at one end into the uppermost portion of inlet fuel reservoir 61 and to open at its other end into a suitable portion of the second fuel return passage means such as the return passage 91 thereof in cover 15, as seen in FIG. 4. In addition, as seen in this same figure, a vapor bleed orifice passage means 97, of predetermined diameter is also provided in the cover 15 so as to open at one end into the uppermost portion of the annular channel 68 passage portion of the first fuel return passage means and to open at its other end into, for example, the return passage 91 of the second fuel return passage means, as shown.

In certain engine applications and for use with other types of electromagnetic fuel injectors, it may also be desirable to provide a supplemental or third vapor bleed orifice passage in the subject assembly to provide for further venting of any fuel vapors from the fuel being delivered to the electromagnetic fuel injectors. Such a third vapor bleed orifice passage is positioned so as to connect the inlet fuel reservoir 61 to the first fuel return passage means, as for example, by means of a vapor bleed passage 98, having a bleed orifice passage 99 of predetermined diameter therein, that is provided in the cover 15 so as to open at one end into an uppermost portion of fuel chamber 61 and at its other end into the transverse passage 67 of the first fuel return passage means, as shown in FIG. 6.

Each of the above-described vapor bleed orifice means should be of a suitable small size so as to permit the flow of fuel vapor therethrough while minimizing the flow of liquid therethrough.

In operation, the gasoline fuel at a low supply pressure in the order of 6 to 15 psi, flowing via the inlet passage 62 into the inlet fuel reservoir 61 may have fuel vapors trapped in the liquid fuel. This entering fuel should have sufficient resident time in the inlet fuel reservoir 61, by proper sizing of this reservoir relative to the rate of fuel flow, so that the vapors can separate from the liquid fuel.

These fuel vapors separating from the liquid fuel well rise toward the upper wall 58 to flow out of the inlet fuel reservoir 61 via the vapor bleed passage 95, as controlled by the vapor bleed orifice passage 96, into the return passage 91 of the second fuel return passage means to be carried by the returning fuel therein back to the fuel tank for the engine.

In addition, if the throttle body injection apparatus 10 has the above-described vapor bleed passage 98 with the bleed orifice 99 therein, fuel vapors will also be bled from the inlet fuel reservoir 61 to the fuel flowing through the first fuel return passage means.

Thus fuel flowing from the inlet fuel reservoir 61 to the fuel chambers 52 supplying fuel to the electromagnetic fuel injectors 26 will be free or relatively free of fuel vapors. The quantity of fuel delivered to the throttle body apparatus 10 should be considerably in excess of that injected by the fuel injectors 26 into the induction system for the engine so that the excess fuel is used to cool the electromagnetic fuel injectors 26 and the fuel body assembly of the apparatus 10, and to purge any fuel vapors that may form within the fuel injectors 26 from these injectors whereby the valves thereof are always covered with liquid fuel so that fuel metering is not affected by the presence of fuel vapor.

Any fuel vapors entrained in the fuel flowing through the first return passage means is then bled therefrom via the vapor bleed orifice passage means 97 to the fuel in the second fuel return passage means prior to this fuel entering the fuel pressure regulator 60.

The vapor bleed passages 95-96, 97, 98, and 99, FIGS. 4 and 6, are considered desirable, the vapor purge they provide can be helpful under adverse conditions, if such conditions are not expected, the passages are not necessary.

Fuel vapors returned to the fuel tank, not shown, may be removed therefrom, as desired, by any of the known fuel vapor recovery or evaporative emission control systems presently used in many automotive vehicles. In one such system, a vapor storage canister is used to receive and store fuel vapors emitted from the fuel tank of the vehicle engine. During engine operation, the fuel vapor stored in such a canister is then purged, as controlled by a suitable purge control valve, into the induction system of the engine so that these fuel vapors can be consumed therein.

The fuel flow to a throttle body injection apparatus 10, constructed in accordance with the invention, may be any suitable amount desired whereby excess fuel is available to effect fuel vapor purge and cooling of the apparatus 10 and of the electromagnetic fuel injectors 26. In a particular construction of such a throttle body injection apparatus 10 as used on a relatively large displacement V-8 engine, with this apparatus 10 having two electromagnetic fuel injectors 26 therein, the fuel flow was in the range of 30 to 45 gallons per hour. It will thus be apparent that, if the throttle body injection apparatus 10 is constructed for use, for example, on a four cylinder engine and has only one electromagnetic fuel injector 26 therein, the fuel delivery to this apparatus may be reduced so that the fuel flow is in the range of, for example, 15 to 30 gallons per hour. Of course, in both of the above examples, only a portion of the fuel thus delivered to a throttle body injection apparatus 10 will be injected by the electromagnetic fuel injectors 26 into the induction system of the engine for combustion within the working cylinders of the engine, the remaining amount being excess fuel.

Although the above fuel flow rates have been found satisfactory in the use described above, it has been found that these flow rates can be reduced in certain applications. However, the amount of fuel entering the apparatus should preferably be substantially greater than the fuel injected into the throttle body in an amount sufficient to effect cooling of the fuel body assembly 19 and the injectors therein so as to avoid substantial fuel vaporization at the fuel metering orifice passages.

Figure 7:
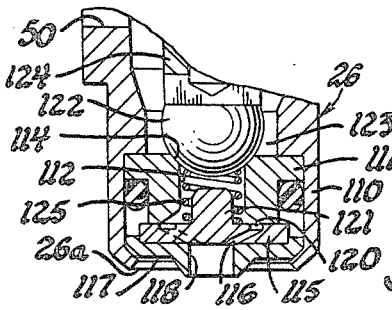
FIG. 7 is an axial sectional view of the lower nozzle portion of an exemplary electromagnetic fuel injector usable in the apparatus of FIGS. 1–5.

As previously described, the electromagnetic fuel injectors 26 are preferably of the type disclosed in the above-identified, copending U.S. Pat. application Ser. No. 838,468 and, as such, would be of the type that includes a solenoid actuated valve used to control fuel flow through the nozzle assembly of such an injector. In the construction illustrated in FIG. 7, the nozzle assembly of this type electromagnetic fuel injector 26, is mounted in the lower wall nozzle case portion of the injector body 110 of the injector 26 and includes in succession, starting from the upper end of the nozzle case portion a seat element 111 in the form of an annular disc which is provided with a central axial outlet port or flow passage 112 therethrough and with a conical valve seat 114 on its upper surface concentric with the flow passage 112, a disc-like swirl director plate 115 having a plurality of circumferentially spaced apart, inclined and axially extending, director passages 116 therethrough, and a spray tip 117 with a spray orifice passage 118 therethrough.

As shown, the director passages 116 in the swirl director plate 115 extend from an annular groove 120 on the upper face of the swirl director plate 115 positioned to encircle an upstanding boss 121 of the swirl director plate which is loosely received in the flow passage 112 through the seat element 111.

Flow through the flow passage 112 in the seat element 111 is controlled by a valve 122 loosely received within a fuel chamber 123 in the injector body that is in flow communication with the inlet and outlet ports 50 and 51, respectively. Valve 122 vertically movable between a closed position at which it is seated against the valve seat 114 and an open or vertically raised position relative to the valve seat. As shown, the valve 122 is of a ball-like configuration, and in the construction illustrated, is of semi-spherical shape, that is, it is a ball truncated at one end to provide a flat or plain surface on its upper side, the lower portion being of ball-shaped configuration whereby to be self-centering and to seat against the conical valve seat 114.

The solenoid, not shown, of the electromagnetic fuel injector 26 has a vertically movable armature 124, which is normally spring biased, the spring not being shown, so that when the solenoid is de-energized the lower slotted end of the armature abuts against the valve 122 to move the valve 122 downward to its closed position in seating engagement against the valve seat 114. The valve 122 is thus an electrically actuated metering valve.

Unseating of the valve 122 from the valve seat 114 is preferably effected by means of a compression valve spring 125. The valve spring 125 is loosely received in the flow passage 112 of the seat element 111 in position to abut at one end against the upper surface of the director plate 115 and to abut at its opposite end against the lower, ball portion of the valve 122. As shown, the upstanding boss 121 not only serves to center the spring 125, but also to appreciably reduce the volume capacity available for fuel in the flow passage 112. During operation, normal seating and actuation of the valve 122 is controlled by the armature 124 of the solenoid assembly of the injector 26 and, accordingly, it will be apparent that the spring 125 only effects unseating of the valve 122 when the solenoid is energized.

Other details of this type of electromagnetic fuel injector 26 are not shown or described, since such details are not deemed necessary for an understanding of the subject invention and, since such details are fully disclosed in the above-identified copending U.S. Pat. application Ser. No. 838,468, the disclosure of which is incorporated herein by reference thereto.

During engine operation, the electromagnetic fuel injectors 26 will inject fuel when energized or electrically pulsed. As above described, these electromagnetic fuel injectors 26 may be pulsed at a varying repetition rate, such as once per engine cylinder, in timed relation to the movement of the crankshaft, not shown, therein so as to discharge fuel into the throttle bores above the throttle valves whereby to provide a desired mixture to the intake manifold 11 of the engine for distribution to the cylinders, not shown, of the engine. When two injectors 26 are used, as in the embodiment illustrated, these injectors will receive alternate pulses with possible overlap of pulses depending on engine operation, and they may be pulsed simultaneously to effect acceleration enrichment.

As previously described, each electromagnetic fuel injector 26 is positioned above the throttle bore 21 with which it is associated so that during fuel injection the fuel is discharged towards the wall of the throttle bore 21 above the throttle valve 24 therein at a distance equivalent to one bore diameter. Preferably each injector 26 provides a symmetrical and uniform fuel delivery into its associated throttle bore 21. Preferably the fuel is injected in a hollow cone spray pattern of a symmetric pattern onto the upper internal wall portion of the throttle bore above the throttle valve therein. Thus again referring to FIG. 7, during fuel injection, fuel flowing through each of the director passages 116 of the injector nozzle assembly is discharged into the spray orifice passage 118 thereof with an eddying or swirl motion such that this swirling movement imparted to the fuel continues as the fuel flows out of the spray orifice passage 118. Such a cone spray pattern provides proper fuel distribution to wet the peripheral wall surface defining the upper portion of the throttle bore under low air flow conditions at closed or nearly closed throttle.

As previously described, the electromagnetic fuel injector 26 may be pulsed at a varying repetition rate, such as once per engine cylinder, in timed relation to the movement of the engine crankshaft or camshaft, not shown. If the injectors are pulsed in this manner, then at high engine speeds, the time interval between each pulse signal will be relatively short compared to the time internal between each pulse signal at low engine speeds, such as at idle or off idle conditions when the throttle valve is closed or nearly closed.

Because of the extended time interval between injection pulses at low engine speed, rough engine operation can occur. However, in accordance with the present invention the possibility of rough engine operation in a pulsed fuel injection system is eliminated by having each electromagnetic fuel injector 26 positioned above its associated throttle bore 21 so that the fuel is discharged therefrom in successive pulses in a spray pattern that is directed toward the interior wall of the throttle body 20 defining the associated throttle bore 21 at a location immediately above the respective throttle valve 24 therein.

The liquid spray pattern from the fuel injector 26 is such that when the engine operates at closed or nearly closed throttle, a substantial portion of the fuel being injected will reach the throttle bore wall in liquid form. The liquid fuel reaching the throttle bore wall will collect thereon and then tend to gravitate downwardly toward the throttle valve 24. As this fuel approaches the throttle valve 24, and especially if it travels into the narrow spaces between the outboard edge of the throttle valve and the throttle bore wall, the fuel is wiped by relatively high velocity and hence low pressure induction air. This induction flow condition usually involves sonic air flow velocities. The liquid fuel on the throttle bore wall subjected to this air flow condition rapidly evaporates and enters the induction air stream in vaporized, combustible form.

When the rate of air flow through the throttle bore is moderate or high during open throttle operation, the fuel droplets in the spray pattern from the fuel injector are drawn into the induction air stream and normally do not reach the throttle bore wall. Under these conditions, the engine operation and air flow is such that the injected fuel quickly evaporates and a well distributed fuel/air mixture is provided for induction into the engine.

In addition with the above arrangement, by providing fuel intake into an electromagnetic fuel injector 26 at its lower end next adjacent to the valve 122 movable relative to valve seat 114 therein and by maintaining a low fuel flow velocity therethrough, the buoyancy of any fuel vapor present will leave only liquid or, so-called solid fuel at the metering lands of these elements. In the preferred embodiment of the electromagnetic fuel injector 26 shown, it will be apparent that fuel flow path therethrough is not tortuous and in fact is a relatively open substantially horizontal flow path whereby to permit fuel vapors to separate from the fuel in a manner so that liquid fuel only is present at the lower metering end of the injector.

By including the electromagnetic fuel injectors 26 and the fuel pressure regulator 60 as an integrated part of the throttle body injection housing assembly, all of these elements and the fuel passages interconnecting these elements are in the intake air flow path to provide for cooling of these elements and of the low pressure fuel therein under hot operating conditions.

In the description I have referred to the space 52, FIG. 5, as the fuel well. As is evident from this Figure, the space is defined by the outer surface of the depending portion of the injector 26 on the inside and on the outside is defined by the bore portion 42 of the housing 14. The space is annular, and the fuel flowing into it through passage 64, FIGS. 5 and 2, and out of it through passage 65 seen in the same FIGS., travels circumferentially around the space and wipes the outside face of the depending portion of the injector 26 to cool the same. Fuel also travels from this space through the passage 50, FIGS. 5 and 7, to the fuel space 123, FIG. 7, which is in communication with the valve seat 114 and hence the fuel discharge passage 112. In addition to the direct cooling action effected by the fuel wiping against the outside surface of the depending portion of the injector 26, the circulating fuel in the fuel well thermally communicates otherwise with the housing 14 so as to cool the same and maintain the fuel space or chamber 123 and the fuel passage 112 and other elements at the discharge part of the injector 26 at a sufficiently cool temperature to provide liquid fuel therein.

What I claim as new and desire to secure by Letters Patent of the United States is:

1. An improved low fuel pressure throttle body fuel injection system for a gasoline internal combustion engine comprising in combination:

a throttle body defining a cylindrical bore communicating at its outlet end with the intake manifold of the engine and at its inlet end being open to atmospheric air;

a throttle disposed in said bore and composed of a butterfly valve rotatable about an axis normal to the axis of the bore and effective as the valve is progressively closed to define curved diametrically opposed crescent moon shaped air flow spaces having progressively less cross section whereby as the throttle is closed air flow between the same and the bore increases in velocity up to sonic velocity when the throttle approaches the closed condition;

a fuel injector disposed upstream of the throttle and coaxial with the bore, the fuel injector receiving fuel at low pressure and injection at such pressure in pulses having a spray pattern with a radial velocity component so as to be directed towards the wall of the bore upstream of the throttle and having fuel flow orifices such as to provide droplet formation incapable of traveling to the walls under open throttle conditions but capable of reaching the walls under closed and nearly closed throttle conditions, whereby with the throttle closed or nearly closed the fuel travels to the bore, collects on the same, and gravitates towards the space between the throttle and the bore, where it is subjected to sonic air flow rates and vaporized, and means to actuate the fuel injector in pulses in timed relation to engine speed such that with the throttle in idle position the fuel penetrates the air stream and collects in the throttle bore to gravitate down the same and under off-idle conditions the fuel is entrained by the air stream before reaching the throttle bore.

2. A low fuel pressure throttle body timed fuel injection system for a spark ignition, internal combustion engine comprising in combination:

a throttle body having opposed inlet and outlet surfaces with at least one longitudinal cylindrical internal wall defining a throttle bore extending from said inlet surface to said outlet surface and adapted for communication at its inlet end with atmospheric air at its outlet end with the intake manifold of the engine;

a throttle valve of circular disc configuration pivotably positioned in said throttle bore intermediate the ends thereof between a closed position and an open position relative to said throttle bore to define therewith diametrically opposed air flow paths of progressively smaller cross-sectional area as said throttle valve is moved from said open position to said closed position;

an injector mechanism operatively connected to said throttle body adjacent to said inlet surface, said injector mechanism including at least one fuel injector disposed upstream of said throttle bore and coaxial therewith in the air flow path to said throttle bore, said fuel injector being adapted to receive low pressure fuel and to inject the same as liquid fuel droplets in a substantial hollow cone spray pattern directed toward said internal wall between said inlet surface and said throttle valve at pulsed intervals dependent on engine speed so that during open throttle valve operating conditions when the time interval between pulses is reduced the rate of air flow through the throttle bore is effective to carry and vaporize the fuel so that substantially no liquid fuel contacts said internal wall whereas during closed or nearly closed throttle valve operating conditions, the rate of air flow through the throttle bore is such as to permit the fuel droplets to travel to the internal wall upstream of the throttle valve to collect on the same and migrate toward the throttle valve where it is subjected to sonic or substantially sonic air flow rates for vaporization into the air stream whereby the engine is continuously supplied with combustible mixture between injection pulses of said fuel injector.

3. A low fuel pressure throttle body timed fuel injection system for a spark ignition, internal combustion engine comprising in combination:

a throttle body having opposed inlet and outlet surfaces with at least one longitudinal cylindrical internal wall defining a throttle bore extending from said inlet surface to said outlet surface and adapted for communication at its inlet end with atmospheric air at its outlet end with the intake manifold of the engine;

a throttle valve of circular disc configuration pivotably positioned in said throttle bore intermediate the ends thereof between a closed position and an open position relative to said throttle bore to define therewith diametrically opposed crescent shaped air flow paths of progressively smaller cross-sectional area as said throttle valve is moved from said open position to said closed position;

an injector mechanism operatively connected to said throttle body adjacent to said inlet surface, said injector mechanism including at least one fuel injector disposed upstream of said throttle bore and coaxial therewith in the air flow path to said throttle bore, said fuel injector being adapted to receive fuel and to inject the same as liquid fuel droplets in a substantial hollow cone spray pattern with an included angle of the order of 90° whereby liquid fuel is directed toward said internal wall between said inlet surface and said throttle valve at pulsed intervals so that during open throttle valve operating conditions the rate of air flow through the throttle bore is effective to carry and vaporize the fuel so that substantially no liquid fuel contacts said internal wall whereas during closed or nearly closed throttle valve operating conditions, the rate of air flow through the throttle bore is such as to permit the fuel droplets to travel to the internal wall upstream of the throttle valve to collect on the same and migrate toward the throttle valve where it is subjected to high velocity air flow rates for vaporization into the air stream whereby the engine is continuously supplied with combustible mixture between injection pulses of said fuel injector.

* * * * *